US005168314A

United States Patent [19]

Gunji et al.

[11] Patent Number: 5,168,314

[45] Date of Patent: Dec. 1, 1992

[54] CLEANING APPARATUS FOR HEAT FIXING DEVICE WHEREIN THE AMOUNT OF CLEANING WEB IS CONTROLLED BASED ON THE NUMBER OF RECORDED SHEETS

[75] Inventors: Kouichi Gunji; Tsutomu Suka; Takaaki Yamanaka; Shogo Kato, all of Hachioji, Japan

[73] Assignee: Konica Corporation, Tokyo, Japan

[21] Appl. No.: 508,111

[22] Filed: Apr. 11, 1990

[30] Foreign Application Priority Data

Apr. 20, 1989 [JP] Japan ..... 1-102154

[51] Int. Cl.[5] ..... G03G 15/20; G03G 21/00

[52] U.S. Cl. ..... 355/283; 355/300; 15/256.51

[58] Field of Search ..... 355/283, 300, 296, 290, 355/295, 284; 219/216, 388; 432/60; 15/256.51, 256.53

[56] References Cited

U.S. PATENT DOCUMENTS

| | | | |
|---|---|---|---|
| 3,941,558 | 3/1976 | Takiguchi | 355/300 X |
| 4,277,161 | 7/1981 | Calabrese | 355/300 X |
| 4,557,588 | 12/1985 | Tomosada | 355/300 |
| 4,568,174 | 2/1986 | Stange | 355/300 |
| 4,939,552 | 7/1990 | Nakanishi | 355/283 X |

FOREIGN PATENT DOCUMENTS

| | | | |
|---|---|---|---|
| 0079699 | 5/1983 | European Pat. Off. | 355/283 |
| 57-44172 | 3/1982 | Japan | 355/283 |
| 58-145977 | 8/1983 | Japan | 355/283 |
| 58-172673 | 10/1983 | Japan | 355/283 |
| 59-90876 | 5/1984 | Japan | 355/283 |
| 60-35768 | 2/1985 | Japan | 355/283 |
| 60-143374 | 7/1985 | Japan | 355/283 |
| 60-176075 | 9/1985 | Japan | 355/283 |
| 62-43682 | 2/1987 | Japan | 355/283 |
| 63-70881 | 3/1988 | Japan | 355/283 |
| 63-70882 | 3/1988 | Japan | 355/283 |
| 63-80286 | 4/1988 | Japan | 355/283 |
| 63-276079 | 11/1988 | Japan | 355/283 |
| 63-276080 | 11/1988 | Japan | 355/283 |
| 1097969 | 6/1984 | U.S.S.R. | 355/283 |

OTHER PUBLICATIONS

IBM Tech. Disc. Bull., "Hot Roll Wiper", vol. 20, No. 8, Jan. 1978, p. 3306.

*Primary Examiner*—R. L. Moses

*Attorney, Agent, or Firm*—Jordan B. Bierman

[57] ABSTRACT

A cleaning apparatus for a fixing device wherein a movable cleaning web is brought into contact with a member of the fixing device to thereby clean the fixing member. The amount or time of rotation of a take-up shaft for taking up the cleaning web is reduced stepwise depending on the number of sheets of recording paper having been subjected to image recording. The amount or time of rotation of the take-up shaft is effected by using the relationship between the increase in the diameter of the take-up roller and the number of copies made stored previously.

4 Claims, 3 Drawing Sheets

CLEANING APPARATUS FOR HEAT FIXING DEVICE WHEREIN THE AMOUNT OF CLEANING WEB IS CONTROLLED BASED ON THE NUMBER OF RECORDED SHEETS

BACKGROUND OF THE INVENTION

1. Field of the Invention

The present invention relates to a cleaning apparatus for a fixing device used in an image forming apparatus such as a laser printer, electrophotographic apparatus, etc. to fix transfer paper having a toner image transferred thereto from the surface of an image retainer by means of a heat roller and a press roller.

2. Description of the Prior Art

In image forming apparatus utilizing electrostatic images, such as electrophotographic reproducing machines, electrostatic recording apparatus, etc., an electrostatic image is formed on an electrostatic image retainer and developed by applying a toner with a developing device to obtain a visible toner image, which is then transferred and fixed to transfer paper (recording paper), thereby obtaining a desired copy.

To fix the toner image to the recording paper, it is common to employ the thermal fixing method in which the toner is fused and thereby fixed to the recording paper by means of a heat roller. Since fixing is accompanied by the offset phenomenon that all the toner on the recording paper is not fixed thereto, but a part of it adheres to the peripheral surface of the heat roller, the roller needs to be cleaned. The cleaning of the heat roller has heretofore been effected by means of a cleaning roller, a cleaning web made of a non-woven fabric, etc.

The prior art that employs a cleaning roller involves the problem that, as the cleaning is repeatedly carried out, the cleaning roller itself gradually becomes stained. In the cleaning by means of a cleaning web made of non-woven fabric or the like, if the cleaning web is taken up by rotating a take-up shaft for a fixed time or through a fixed angle for each cleaning operation, the roll diameter of the take-up shaft gradually increases and consequently the amount of cleaning web fed for each cleaning operation also gradually increases, resulting in the cleaning web being fed more than is necessary. To overcome this problem, a method in which the amount of feed of the cleaning web is controlled by means of a pinch roller as in the case of a tape recorder (see Japanese Patent Laid-Open No. 58-182673) and another method in which the roll diameter of the take-up shaft is detected at all times to control the amount of cleaning web taken up (Japanese Patent Laid-Open No. 60-143374) have been proposed. These methods, however, involve the problems that the mechanism becomes complicated and costly due to necessity for a tension arm or a sensor and that the pinch roller or the sensor also become stained.

SUMMARY OF THE INVENTION

The present invention aims at solving the above-described problems of the prior art.

It is a primary object of the present invention to provide a fixing apparatus which enables a cleaning web to be efficiently used without waste by controlling the amount of feed of the cleaning web in accordance with the number of copies having been made.

The above-described object is attained by a cleaning apparatus for a fixing device designed to bring a movable cleaning web into contact with a member of the fixing device which is to be cleaned while taking up the web to thereby clean the fixing member, wherein the amount or time of rotation of a take-up shaft for taking up the cleaning web is controlled by integrating means for counting the number of sheets of recording paper having been subjected to image recording.

The drive of the cleaning web take-up roller is controlled in accordance with the number of copies made, so that the amount of feed of the cleaning web can be always maintained at a substantially constant level. It is therefore possible to solve the problem with the prior art that the amount of cleaning web fed for each cleaning operation gradually increases as the roll diameter of the take-up roller increases, resulting in the cleaning web running to waste. Accordingly, it is possible to provide a cleaning apparatus for a fixing device which is less costly and capable of performing effective and reliable cleaning without waste.

The above and other objects, features and advantages of the present invention will become more apparent from the following description, taken in conjunction with the accompanying drawings.

DESCRIPTION OF THE PREFERRED EMBODIMENT

Figure 1:
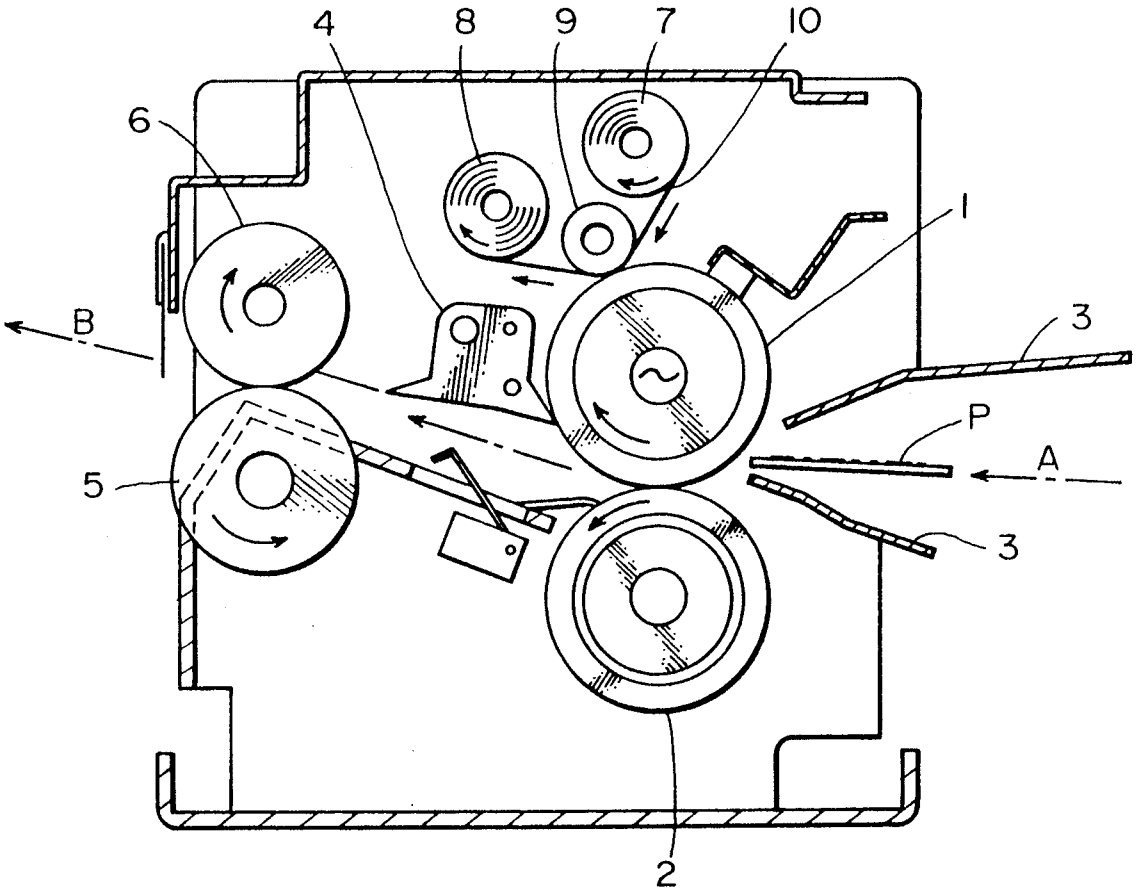
FIG. 1 is a sectional view of one example of a fixing device provided with one embodiment of a cleaning apparatus according to the present invention.

Referring to FIG. 1, the reference numeral 1 denotes a heat roller for fixing which has a built-in heater and is driven to rotate clockwise, as shown by an arrow, at a predetermined peripheral speed by a driving mechanism incorporated in an image recording apparatus. The reference numeral 2 denotes a press roller disposed in opposing relation to the heat roller 1, the press roller 2 being in press contact with the peripheral surface of the heat roller 1 so as to be driven thereby to rotate counterclockwise. When recording paper P having a toner image transferred to the upper surface thereof is fed toward the nip of the two rollers 1 and 2 from a direction shown by an arrow A through forward guide plates 3, the heat roller 1 and the press roller 2 hold the recording paper P therebetween and transport it leftward as viewed in the figure. During this process, the heat roller 1 fuses the toner by means of the heater built in it. After coming out of the nip, the recording paper P cools down to fix the toner thereto and is then sent to a delivery roller 5 through a separating pawl 4. The delivery roller 5 is driven to rotate counterclockwise in timed relation to the rotation of the heat roller 1. A reference numeral 6 denotes a press roller disposed in opposing relation to the delivery roller 5. The recording paper P is held between these two rollers 5 and 6 and thereby delivered, as shown by an arrow B.

The peripheral surface of the heat roller 1 having conducted thermal fixing has some toner, carrier, dust, etc. attached thereto during the fixing process, which would stain an image produced in a subsequent fixing operation. Cleaning of the heat roller 1 by means of a cleaning web according to the present invention is therefore conducted.

A reference numeral 7 in FIG. 1 denotes a supply roller which is wound with a cleaning web 10 made of a non-woven fabric or the like. The cleaning web 10 is pressed against the peripheral surface of the heat roller 1 by means of a press roller 9 so as to transfer the attached toner to the cleaning web 10 when taken up onto a take-up roller 8, thereby effecting cleaning of the heat roller 1.

If the non-woven fabric constituting the cleaning web 10 is impregnated with silicone oil or the like, the cleansing effectiveness is enhanced.

Figure 2:
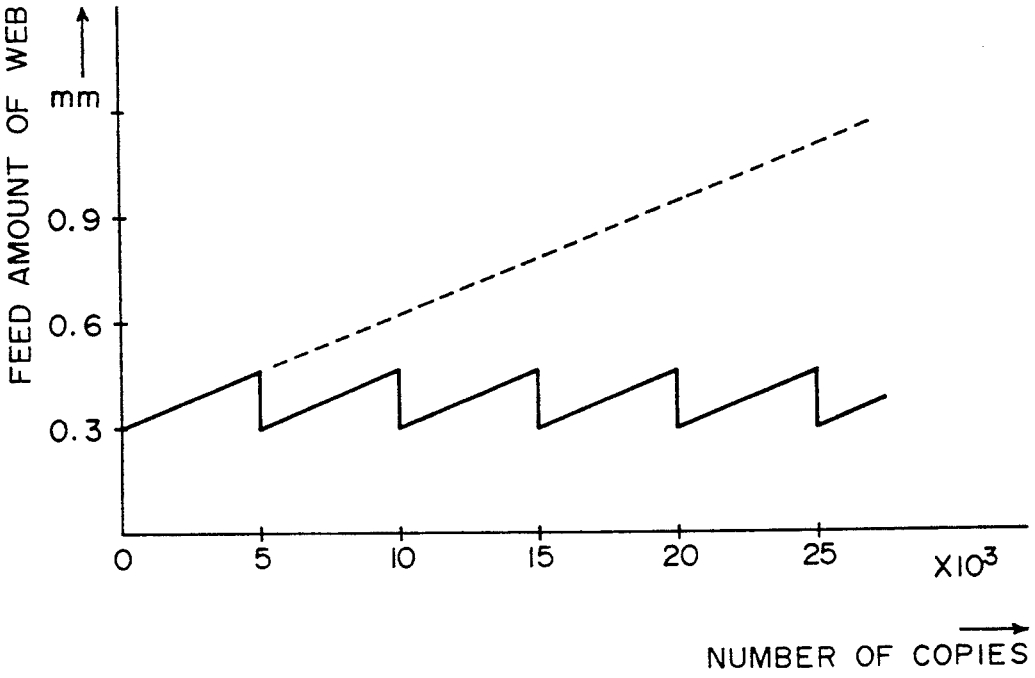
FIG. 2 is a graph showing the relationship between the amount of cleaning web taken up and the number of copies made.
Figure 3:
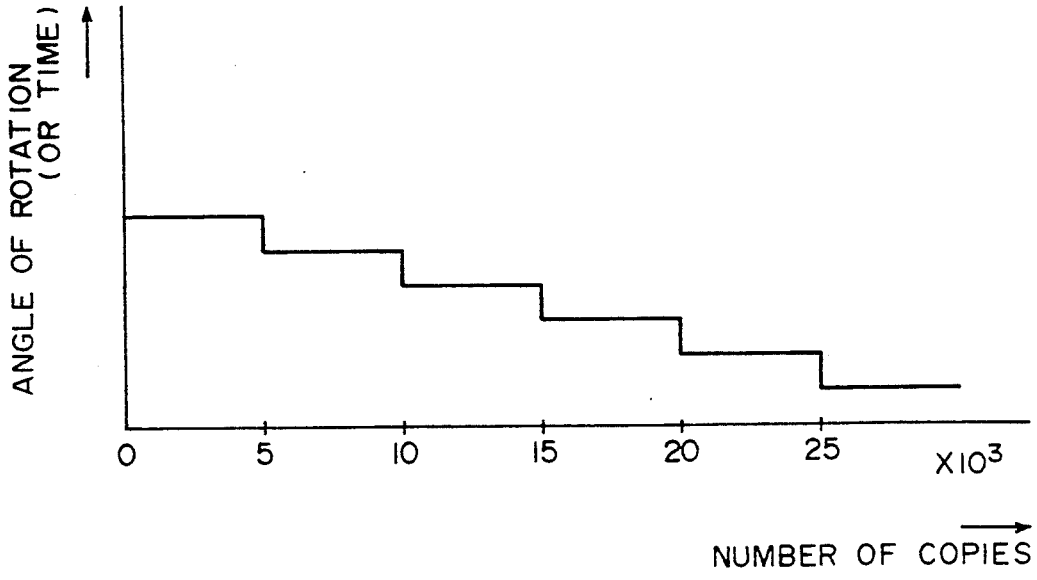
FIG. 3 is a graph showing the relationship between the angle of rotation of a take-up shaft and the number of copies made.

If the take-up roller 8 is driven for a fixed time or through a fixed angle of rotation for each cleaning operation, since the roll diameter of the take-up roller 8 gradually increases due to the cleaning web 10 taken up, the amount of cleaning web 10 fed for each cleaning operation gradually increases. Therefore, the relationship between the increase in the roll diameter of the take-up roller 8, the increase in the amount of feed of the cleaning web 10 and the total number of copies made (the total number of sheets of recording paper having been subjected to image recording) is investigated in advance, and the rotational drive of the take-up roller 8 is controlled so that the amount of feed of the cleaning web 10 is maintained at a constant level irrespective of the increase in the number of copies made, that is, the roll diameter of the take-up roller 8. The relationship therebetween is shown in FIGS. 2 and 3. More specifically, FIG. 2 shows the relationship between the amount of feed of the cleaning web 10 and the number of copies made, while FIG. 3 shows the relationship between the time or angle of rotation of the take-up roller 8 and the number of copies made.

If the take-up roller 8 is driven to rotate for a fixed time or through a fixed angle for each cleaning operation from the time of starting a copying operation with a newly set cleaning web 10, the amount of cleaning web 10 fed for each cleaning operation undesirably increases monotonously, as shown by a chain line in FIG. 2. In the present invention, however, the drive of the take-up roller 8 is controlled every time a predetermined number of copies are made. For example, every time the number of copies made reaches 500, the angle through which the take-up roller 8 is rotated is reduced stepwisely, as shown in FIG. 3. Thus, it is possible to maintain the amount of feed of the cleaning web 10 at a substantially constant level. In other words, the average of the amounts of feed of the cleaning web 10 always falls in a predetermined feed range.

Figure 4:
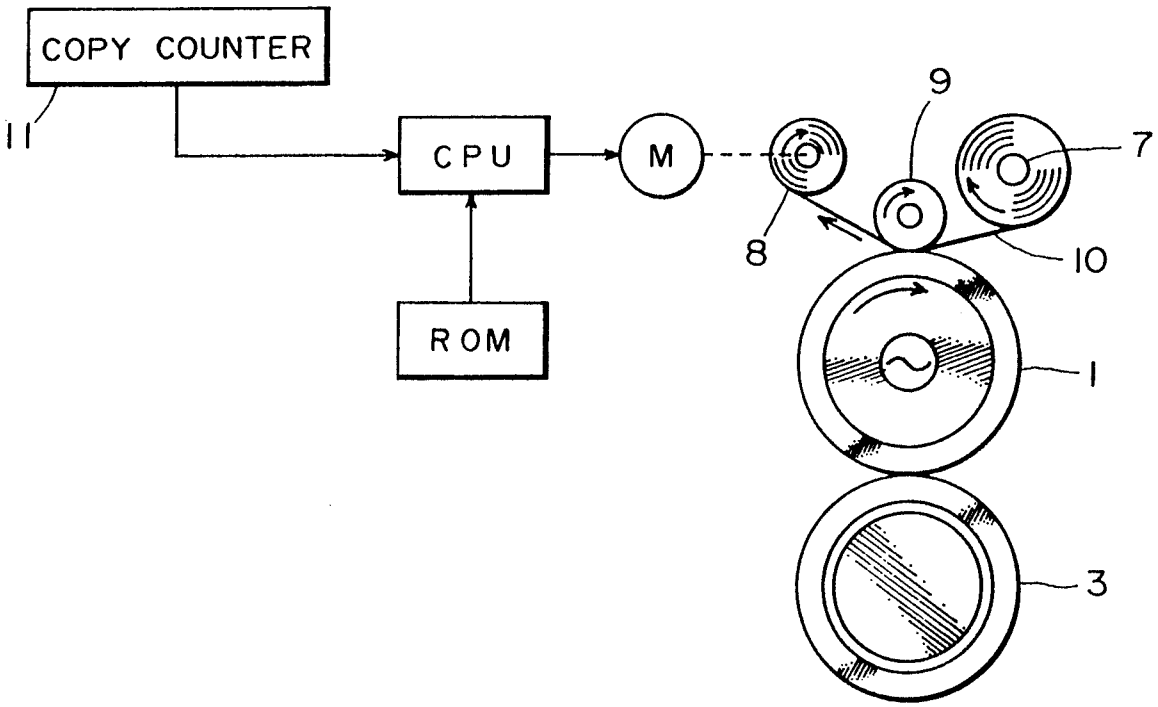
FIG. 4 is a block diagram showing drive control effected by a CPU.

The drive control of the take-up roller 8 is effected by a CPU that controls the image recording apparatus, as shown in FIG. 4. More specifically, the relationship between the increase in the roll diameter of the take-up roller 8 and the number of copies made is previously stored as being a coefficient in a ROM (Read-Only Memory) incorporated in the CPU (microprocessor), so that the CPU can effect the above-described control by use of the stored data and information available from a copy counter 11.

The drive control of the take-up roller 8 can be readily effected by use of a driving means M which is activated in response to a control signal from the CPU, for example, a pulse motor or an electrically-operated clutch or a solenoid.

What is claimed is:

1. An image forming apparatus comprising a fixing device having a heat roller, a cleaning apparatus comprising a cleaning web brought into contact with said heat roller to clean said heat roller, said cleaning apparatus further comprising;

a rotatable supply shaft around which said cleaning web is wound, a rotatable take up shaft for taking up said cleaning web from said supply shaft, a driver for driving said take up shaft, whereby said take up shaft takes up said cleaning web; and a controller for controlling an angle of rotation of said take up shaft, or a period of rotation of said take up shaft, based on the number of sheets of recording paper having been subjected to image recording, said angle of rotation of said take up shaft or said period of rotation of said take up shaft being reduced stepwise.

2. An image forming apparatus comprising a fixing device having a heat roller, a cleaning apparatus comprising a cleaning web brought into contact with said heat roller to clean said heat roller, said cleaning apparatus further comprising;

a rotatable supply shaft around which said cleaning web is wound, a rotatable take up shaft for taking up said cleaning web from said supply shaft, a driver for driving said take up shaft, whereby said take up shaft takes up said cleaning web; and a controller for controlling an angle of rotation of said take up shaft, or a period of rotation of said take up shaft, based on the number of sheets of recording paper having been subjected to image recording, wherein said controller controls said angle of rotation of said take up shaft or said period of rotation of said take up shaft based on a relationship between an increase in a diameter of cleaning web wound around said take up shaft and a number of sheets of recording paper having been subjected to image recording.

3. An image forming apparatus comprising a fixing device having a heat roller, a cleaning apparatus comprising a cleaning web brought into contact with said heat roller to clean said heat roller, said cleaning apparatus further comprising;

a rotatable supply shaft around which said cleaning web is wound, a rotatable take up shaft for taking up said cleaning web from said supply shaft, a driver for driving said take up shaft whereby said take up shaft takes up said cleaning web; and a controller for controlling an angle of rotation of said take up shaft, or a period of rotation of said take up shaft, based on the number of sheets of recording paper having been subjected to image recording, wherein said controller controls said angle of rotation of said take up shaft or said period or rotation of said take up shaft whereby said angle of rotation or said period of rotation is reduced as a number of sheets of recording paper subjected to image recording increases.

4. An image forming apparatus comprising a fixing device having a heat roller, and a cleaning apparatus comprising a cleaning web brought into contact with said heat roller to clean said heat roller, said cleaning apparatus further comprising;

a rotatable supply shaft around which said cleaning web is wound, a rotatable take up shaft for taking up said cleaning web from said supply shaft, a driver for driving said take up shaft whereby said take up shaft takes up said cleaning web; and a controller for controlling an angle of rotation of said take up shaft, or a period of rotation of said take up shaft, based on the number of sheets of recording paper having been subjected to image recording, said apparatus further comprising a memory for storing previously recorded data corresponding to a relationship between an increase in the diameter of cleaning web wound around said take up shaft, and a number of sheets of recording paper subjected to image recording, said controller controlling said angle of rotation of said take up shaft, or said period of rotation of said take up shaft, based on said data.

* * * * *